US007872619B2

(12) United States Patent
Miller et al.

(10) Patent No.: US 7,872,619 B2
(45) **Date of Patent: *Jan. 18, 2011**

(54) ELECTRO-LUMINESCENT DISPLAY WITH POWER LINE VOLTAGE COMPENSATION

(75) Inventors: Michael E. Miller, Honeoye Falls, NY (US); Michael J. Murdoch, Rochester, NY (US); John W. Hamer, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 705 days.

This patent is subject to a terminal disclaimer.

(21) Appl. No.: 11/555,455

(22) Filed: Nov. 1, 2006

(65) Prior Publication Data

US 2008/0100542 A1 May 1, 2008

(51) Int. Cl.
*G09G 3/30* (2006.01)

(52) U.S. Cl. ..... 345/77

(58) Field of Classification Search ..... 345/76–84, 345/204; 315/169.3; 250/553
See application file for complete search history.

(56) References Cited

U.S. PATENT DOCUMENTS

| | | | | |
|---|---|---|---|---|
| 6,380,943 | B1 | 4/2002 | Morita et al. | |
| 6,384,836 | B1 * | 5/2002 | Naylor et al. | 345/589 |
| 6,690,117 | B2 | 2/2004 | Komiya | |
| 7,009,627 | B2 | 3/2006 | Abe et al. | |
| 7,629,955 | B2 * | 12/2009 | Asao et al. | 345/96 |
| 2001/0000217 | A1 | 4/2001 | Ono et al. | |
| 2001/0035850 | A1 | 11/2001 | Okamoto et al. | |
| 2003/0085905 | A1 | 5/2003 | Mori et al. | |

(Continued)

FOREIGN PATENT DOCUMENTS

WO WO2004/023446 3/2004

(Continued)

OTHER PUBLICATIONS

U.S. Appl. No. 11/316,443, filed Dec. 22, 2005; of Michael E. Miller et al; titled "Electroluminescent Display Brightness Level Adjustment".

*Primary Examiner*—Sumati Lefkowitz
*Assistant Examiner*—Rodney Amadiz
(74) *Attorney, Agent, or Firm*—Morgan Lewis & Bockius LLP

(57) ABSTRACT

An active matrix electro-luminescent display system, comprising: a display composed of an array of regions of light-emitting elements, pixel driving circuits for independently controlling the current to each light-emitting element, one or more display drivers for receiving an input image signal for data to drive the pixel driving circuits and generating a converted image signal for driving the light emitting elements in each region of the display through signals provided through data lines and select lines, wherein the one or more display drivers sequentially receive the input image signal for driving the light emitting elements within each region of the array of regions, analyzes the input image signal received for each region to estimate the current that would result at, at least, one point along at least one power line providing current to each region, if employed without further modification, based upon device architecture and material and performance characteristics of device components, and sequentially generates a converted image signal for driving the light emitting elements in each region as a function of the input image signal and the estimated currents.

20 Claims, 12 Drawing Sheets

U.S. PATENT DOCUMENTS

2003/0122494 A1 7/2003 Ide
2003/0122813 A1* 7/2003 Ishizuki et al. ..... 345/211
2003/0201727 A1 10/2003 Yamazaki et al.
2004/0004444 A1 1/2004 Choi et al.
2004/0150592 A1 8/2004 Mizukoshi et al.
2005/0062696 A1 3/2005 Lo
2006/0007249 A1 1/2006 Reddy et al.
2006/0145969 A1* 7/2006 Fish et al. ..... 345/77

FOREIGN PATENT DOCUMENTS

WO WO2004/114273 12/2004
WO WO2005/022500 3/2005
WO WO2005/122120 12/2005

* cited by examiner

ELECTRO-LUMINESCENT DISPLAY WITH POWER LINE VOLTAGE COMPENSATION

FIELD OF THE INVENTION

The present invention relates to actively-addressed electro-luminescent display systems and a method for automatically adjusting the behavior of an active matrix electro-luminescent display dependent upon input image information to compensation for voltage losses along power supply lines.

BACKGROUND OF THE INVENTION

Emissive display technologies, including displays based on cathode-ray tubes (CRTs) and plasma excitation of phosphors have become very popular within many applications since these technologies natively have superior performance characteristics over reflective or transmissive display technologies, such as displays produced using liquid crystals (LCDs). Among the superior characteristics of these displays is higher dynamic range, wider viewing angle, and, often, lower power consumption. The power consumption of emissive display technologies, however, is directly dependent upon the signal that is input to the display device since the typical emissive display will require almost no power to produce a black image but a significantly higher power to produce a highly luminous white image. More recently, organic light emitting diodes (OLEDs) have been discussed for use in displays and other light emitting devices. Like CRTs and plasma displays, devices constructed based on OLEDs are emissive and have the characteristic that power consumption is dependent upon the input signal.

It is known to control the power of an emissive display by controlling the input signal to the display. For example, U.S. Pat. No. 6,380,943 entitled "Color Display Apparatus", US 2001/0035850 entitled "Image reproducing method, image display apparatus and picture signal compensation device", US 2003/0085905 entitled "Control apparatus and method for image display", US 2001/0000217 entitled "Display Apparatus", US 2003/0122494 entitled "Driving Device for Plasma Display Panel" all discuss methods for controlling the power of an emissive display, generally plasma displays, wherein the power is estimated for each field or frame of an image signal and the data signal is scaled as a function of some estimate of the average field or frame power to control the overall power of the emissive display. The primary goals of the methods described within these disclosures are to reduce the peak power requirements of the display devices and/or to control the heat that is generated within these display devices. However, these disclosures do not address the fact that active matrix electro-luminescent (EL) displays, such as OLED displays, use a driving arrangement that is significantly different in structure than is applied in plasma displays and therefore require a different approach to power reduction to avoid imaging artifacts while reducing the power of the display device.

In a typical active matrix EL display, row drivers sequentially provide a select voltage to rows of select lines while column drivers provide a voltage to vertical rows of data lines. A pixel driving circuit is formed at each intersection of these select and data lines, typically comprising a select TFT, a capacitor, and a power TFT. This pixel driving circuit then regulates the current provided to each EL light-emitting element within the display device based upon a separate data voltage signal that is provided on the data lines. The circuit generally also consists of a pair of power lines, comprising a supply power line and a return power line. By controlling the voltage between the gate and source of a power TFT within the pixel driving circuit, the pixel driving circuit modulates the current that flows from the supply power line through the OLED, producing light, and back to the return power line.

Unfortunately, the current supplied to the EL light-emitting element by this pixel driving circuit is dependent upon the voltage between the pair of power lines. Ideally, the voltage supplied by the power lines is constant for each pixel driving circuit. However, current is typically provided to a large number of EL light-emitting elements by a single pair of power lines and because the power lines have a finite resistance, an unintended voltage differential is produced that is proportional to the current that is conducted through each power line and the resistance of each power line. Since the unintended voltage differential is positively correlated with current and resistance, the loss of voltage along the power lines will be larger when the lines carry high currents or when the lines have a high resistance. This results in an unintended variation in the voltage supplied to each pixel driving circuit along the power lines, and subsequent variation in both the current supplied to and therefore the luminance provided by each EL light-emitting element that is connected in series by the power lines. The phenomenon that produces this unintended voltage differential is commonly referred to as "IR drop". Further, because the resistance of the power lines increases with length, this IR drop will result in the gradual loss of luminance for OLEDs along the power lines as the distance from the power source increases. This loss of luminance has the potential to create undesirable imaging artifacts. Therefore, there is a need to avoid these artifacts. A common method to avoid these artifacts in active matrix displays is to orient the data and power lines vertically on the display substrate as this dimension of the display is typically shorter than the width of the display and therefore the power lines provide current to fewer OLEDs than if the power lines were oriented horizontally. Additionally, these power lines are often connected to a power source at both ends to further reduce the IR drop across their length.

The types of and degree of these artifacts vary based upon the overall display structure and drive characteristics that are employed. For example, EL displays formed from OLEDs are commonly constructed on large substrates of amorphous silicon using what is termed a non-inverted structure (i.e., a structure in which the anode is formed on the substrate as opposed to on top of the OLED). In this structure, the active matrix circuit controls the gate-to-source voltage on a power TFT within the OLED structure and this gate-to-source voltage, which is the voltage provided to drive the OLED, is determined by computing the data voltage minus the voltage of the power line minus the voltage across the OLED. In this configuration, because the OLED voltage is often larger than the data voltage, the presence of the OLED voltage in this equation helps to reduce the effect of drops in power line voltage upon the gate-to-source voltage. Unfortunately, the voltage that is provided to the OLED cannot be directly computed but requires an iterative set of calculations to provide an adequate estimate of this entity and therefore it can be difficult to compensate for losses in power line voltage due to IR drop. In another example, OLEDs may also be formed in an inverted structure having the cathode formed on the substrate and allowing the amorphous silicon substrate to drive electrons into the OLED. In this configuration, the gate-to-source voltage is dependent upon only the data voltage and the voltage across the power lines. While the voltage to the OLED may be computed using a single equation in this configuration, a smaller change in power line voltage will have a much larger effect on the gate-to-source voltage than the same change in the voltage across the power lines for a non-inverted OLED configuration as the data voltage will often be significantly smaller than the voltage across the power lines. For this reason, the construction of inverted OLEDs on amorphous silicon is generally avoided as image artifacts commonly occur due to IR loss along the power line.

One method to reduce the artifacts due to IR drop is to reduce the resistance of the power lines as suggested in US 2004/0004444 entitled "Light emitting panel and light emitting apparatus having the same". Resistance can be reduced by using more conductive materials or by increasing the cross-sectional area of the power lines. In some cases, a highly conductive plane of material can be used in place of one or more individual power lines to reduce the resistance, but this depends on the structure of the device, and it is not always possible to find materials with sufficient properties and/or methods to produce this plane of material. Similarly, the materials that are available to reduce resistance and the cross-sectional area of individual power lines are often fixed by the manufacturing technology that is available, so it is often not cost effective to reduce the resistance of the power lines. Finally, in larger displays, the power lines are typically longer and there are a larger number of EL light-emitting elements connected to each set of lines. The power lines therefore tend to have higher resistance and tend to carry higher currents than those on smaller displays. This often limits the size or luminance of displays that can be produced using EL technology.

It has been suggested that automatic brightness limits can be imposed on OLED displays to limit their power. U.S. Pat. No. 6,690,117 entitled "Display device having driven-by-current type emissive element" discusses a resistor that is placed between the power source and the power lines of an OLED display device. A current dependent voltage drop then takes place across this resistor, reducing the voltage when high currents are present (i.e., when the display has a high relative luminance). This results in a lower data voltage at every OLED in the display and therefore reduces the current that is required at each OLED at the cost of lower luminance. The voltage drop across this resistor can also be sensed and the contrast of the input signal can be modified, dependent upon the voltage drop. While this technique does reduce the peak currents that must be delivered and therefore limits the voltage drop that can occur across the power lines due to IR drop, this technique does not allow a predictable response at each OLED. In fact, it can actually result in additional undesirable artifacts as some TFTs in the panel may be driven at a voltage level below their saturation region, resulting in a further reduction in luminance, and more variability, in the current conducted through the OLEDs for a given data voltage. For this reason, the technique taught, while controlling the power of an active matrix OLED display, does not necessarily reduce the artifacts that occur as a result of IR drop to an acceptable level.

US20050062696 entitled "Display apparatus and method of a display device for automatically adjusting the optimum brightness under limited power consumption" provides a function similar to U.S. Pat. No. 6,690,117 as a resistor is attached to the cathode which also results in reducing the voltage drop across an OLED in the presence of high currents. This disclosure does not, however, recognize or propose a solution to the problem that IR drop can be different for different power lines and that different luminance levels may result between light emitting elements driven by neighboring power lines when high current loads are present.

Digital implementations of similar processes are used to automatically reduce the brightness level of a display under conditions of high power. For instance, U.S. Pat. No. 6,380,943 entitled "Color Display Apparatus" discusses a method for controlling the power consumed wherein this method includes a method for estimating the power consumed by a RGB display, which might include a "light emission diode apparatus". Within the power estimation method, the power consumed by each color channel is calculated individually using different gains and the resulting values are summed to compute the total power. Generally, the method for controlling the power is applied to the entire field or frame of data. This disclosure does recognize that it may be desirable to update a portion of a display device at a time to reduce memory requirements and therefore power may be computed for a sub-region within the display at a time. However, the described methods can still result in objectionable artifact levels as this disclosure does not recognize or propose a solution to the problem that IR drop can be different for different power lines and that different luminance levels may result between light emitting elements driven by neighboring power lines when high current loads are present. Further, this approach requires that the computation be performed for large portions of, if not the entire, image frame before applying compensation. To perform such a calculation before displaying the resulting image, it is necessary to buffer an entire image in memory, which requires enough memory to store an entire frame of data, significantly increasing the cost of the overall display system. Additionally in displays that are used in applications that require immediacy, the use of a frame buffer can noticeably and unacceptably delay the presentation of visual information. For instance when such a displays is connected to a gaming system, a user can notice the delay of one frame when making a control movement that is expected to immediately impact the video image that is presented.

Copending, commonly assigned U.S. Ser. No. 11/316,443 filed Dec. 22, 2005 describes an electroluminescent display system comprising a display driver for receiving an input image signal and generating a converted image signal for driving the light emitting elements in the display, wherein the display driver analyzes an input image signal for a complete image to be displayed to estimate the current that would result at, at least, one point along at least one power line providing current to each of a plurality of regions, and generates a converted image signal as a function of the input image signal and the estimated currents. Similarly as for the automatic brightness level controlling references discussed above, the specific examples disclosed require that conversion computations be performed for the entire image frame before applying compensation.

U.S. Pat. No. 7,009,627 entitled "Display apparatus and image signal processing apparatus and drive control apparatus for the same" describes a passive matrix EL display in which the row electrodes are scanned and a modulation signal is provided to the column electrodes, wherein the signal that is provided is created by analyzing the input image to calculate both a coefficient to adjust the luminance of the entire image and a compensation for the fluctuation of display luminance due to voltage drop across the row electrodes. As with the earlier disclosures, the calculation of the coefficient to adjust the luminance of the image requires that the content of the entire image be available for analysis before it is displayed. Therefore, the implementation of this approach would require a buffer to store the entire frame of data. Further, since this disclosure provides only a method of compensating for IR drop in passive matrix devices it does not discuss the effect of active drive circuitry or associated drive electronics on the relevant artifact avoidance methods and especially does not discuss such methods that consider the interaction of OLED architecture with active matrix backplanes.

There is a need, therefore, for a method to reduce apparent artifacts in active matrix electro-luminescent (EL) displays, such as OLED displays, that can result when high current levels are required along power lines with a finite resistance to enable the manufacture of larger and/or brighter displays with reduced visual artifacts in a way that does not require substantial increases in display system cost, such as may occur through the addition of frame memory buffers or without requiring a substantial delay in image presentation. Further, the implementation of such a method should be applicable or tunable to active matrix EL displays employing different EL architectures.

SUMMARY OF THE INVENTION

In accordance with one embodiment, the invention is directed towards an active matrix electro-luminescent display system, comprising:

a) a display composed of an array of regions, wherein the current to each of the regions is provided by a pair power lines, at least one power line oriented along a first dimension of the display, each region including an array of light emitting elements for emitting light;

b) pixel driving circuits for independently controlling the current to each light-emitting element in response to an image signal, wherein the intensity of the light output by the light emitting elements is dependent upon the current provided to each light emitting element;

c) an array of select lines orientated along the first dimension for sequentially providing a signal to the pixel driving circuits within each of the array of regions, allowing the pixel driving circuits within any one region to be selected to receive a data signal at any moment in time;

d) an array of data lines oriented along a second dimension of the display that is perpendicular to the first dimension, wherein the data lines provide the image signal to the pixel driving circuit for each light-emitting element;

e) one or more display drivers for receiving an input image signal for data to drive the pixel driving circuits and generating a converted image signal for driving the light emitting elements in each region of the display through signals provided through the data lines and select lines, wherein the one or more display drivers sequentially receive the input image signal for driving the light emitting elements within each region of the array of regions, analyzes the input image signal received for each region to estimate the current that would result at, at least, one point along at least one of the power lines providing current to each region, if employed without further modification, based upon device architecture and material and performance characteristics of device components, and sequentially generates a converted image signal for driving the light emitting elements in each region as a function of the input image signal and the estimated currents.

DETAILED DESCRIPTION OF THE INVENTION

Figure 1:
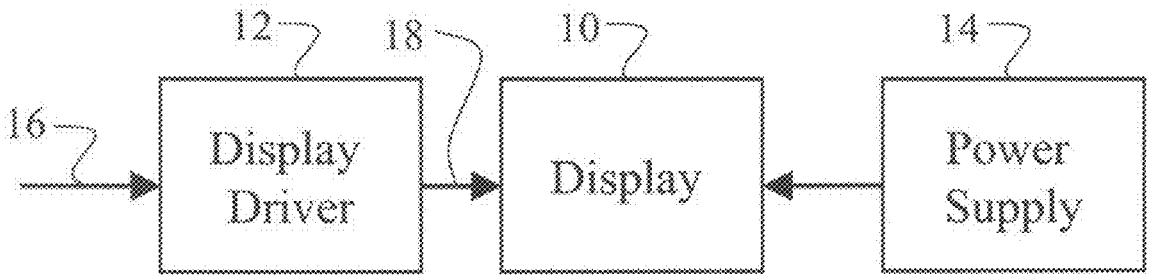
FIG. 1 is a block diagram of a display system according to the present invention.
Figure 2:
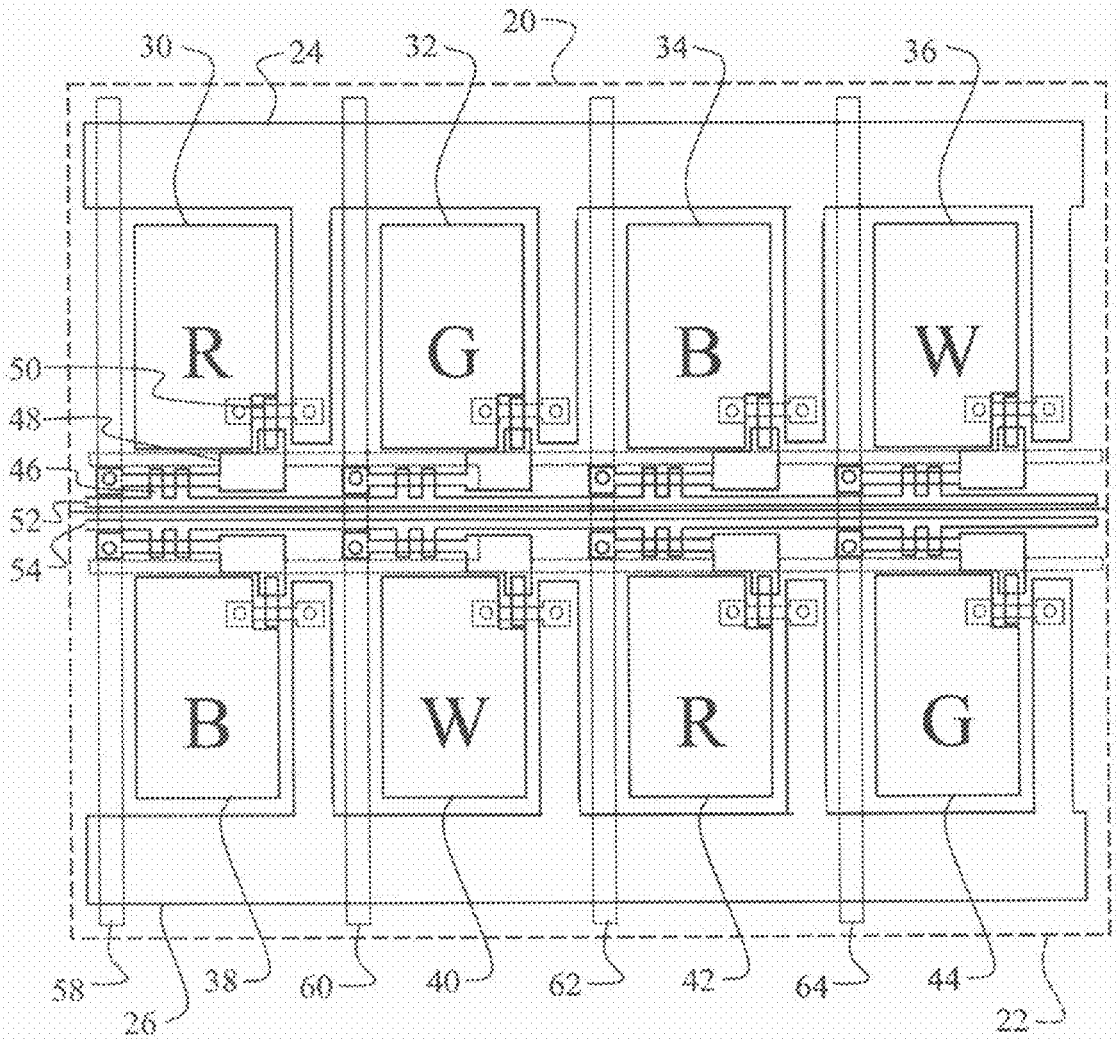
FIG. 2 is a schematic drawing of a portion of a display circuit layout useful in a display system of the present invention.

The present invention provides an active matrix electro-luminescent display system as depicted in FIG. 1, which is comprised of a display 10 and a display driver 12. This system will also likely be comprised of a power supply 14 to provide power to the display 10. Within this system, the display, a portion of which is depicted in FIG. 2, will be composed of an array of regions 20, 22, wherein the current to each of the regions is provided by a pair power lines, at least one power line 24, 26 oriented along a first dimension of the display, each region 20, 22 including an array of light emitting elements for emitting light 30, 32, 34, 36, 38, 40, 42, 44 and wherein the current to each light emitting element is controlled by a pixel driving circuit. While only one power line 24, 26 is depicted for each region, each region will generally also be provided with a second power line in the form of a common top electrode layer, such as layer 188 in FIG. 9 or 138 in FIG. 7 discussed below. As shown in FIG. 2, the circuit for each light emitting element is comprised of a select TFT 46, a capacitor 48, and a power TFT 50. An array of select lines 52, 54 are oriented along the first dimension of the display, substantially parallel to the power lines 24, 26 for sequentially providing a signal to the pixel driving circuits within each of the array of regions, allowing the pixel driving circuits within any one region to be selected to receive a data signal at any moment in time. An array of data lines are oriented along a second dimension of the display that is perpendicular to the first dimension, wherein each data line 58, 60, 62, 64 provides a data signal to a pixel driving circuit within the selected region and wherein each pixel driving circuit independently controls the current to each of the light-emitting elements in response to the data signal that is provided by the data lines and wherein the intensity of the light output by each the light emitting element is dependent upon the current provided to each light emitting element 30, 32, 34, 36, 38, 40, 42, 44.

Within this system, the one or more display drivers receive an input image signal 16 and generate a converted data signal 18 to be provided to each of the pixel driving circuits by the data lines to drive the light emitting elements in the display.

Figure 3:
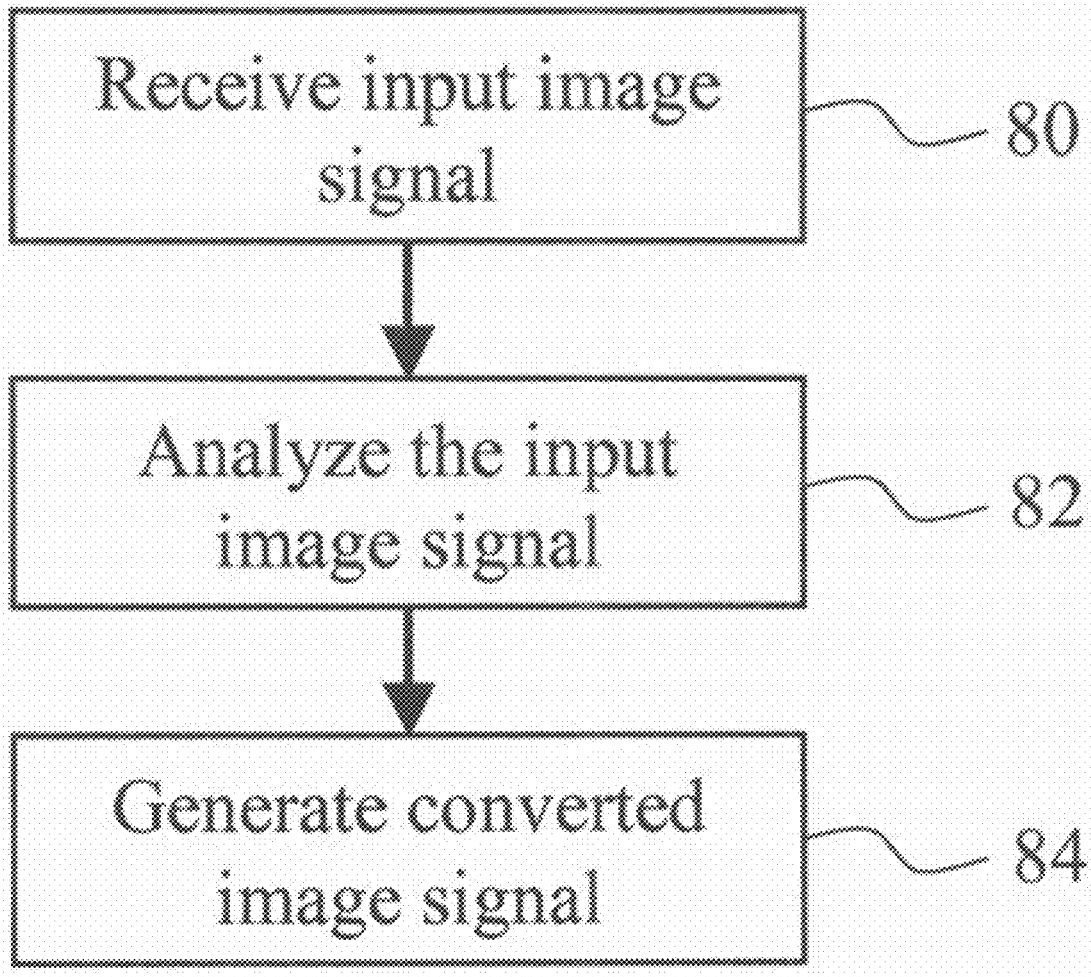
FIG. 3 is a flow chart of the primary steps of a process in accordance with an embodiment of the invention.

The process, as shown in FIG. 3, is employed by the one or more display drivers includes; sequentially receiving 80 the input image signal 16 for driving the light emitting elements (e.g., 30, 32, 34, 36) within each region 20, analyzes 82 the input image signal to estimate the current that would result at, at least, one point along at least one of the power lines 24 providing current to each of the region 20 defined by the power line 24 during which it is assumed that the pixel driving circuit was not influenced by voltage drops along the power line, and then sequentially generating 84 the converted image signal for driving the light emitting elements with each region as a function of the input image signal and the estimated currents. Within this invention, although it is not required, it will generally be desirable to calculate the current at numerous, if not all of the, pixel driving circuits along the power line 24. Since the data lines provide a data signal to the pixel driving circuits that are located in a region 20 defined by the power line 24 that is substantially perpendicular to the second dimension defined by the orientation of the data lines 58, 60, 62, 64, the input image signals only need to be buffered for the light-emitting elements that are located along one power line at any given time. As such, the amount of data that must be buffered to calculate the IR drop at each pixel driving circuit and the time delay introduced by this buffering is reduced as compared to the systems of the prior art, which require an entire frame of data to be buffered.

Figure 4:
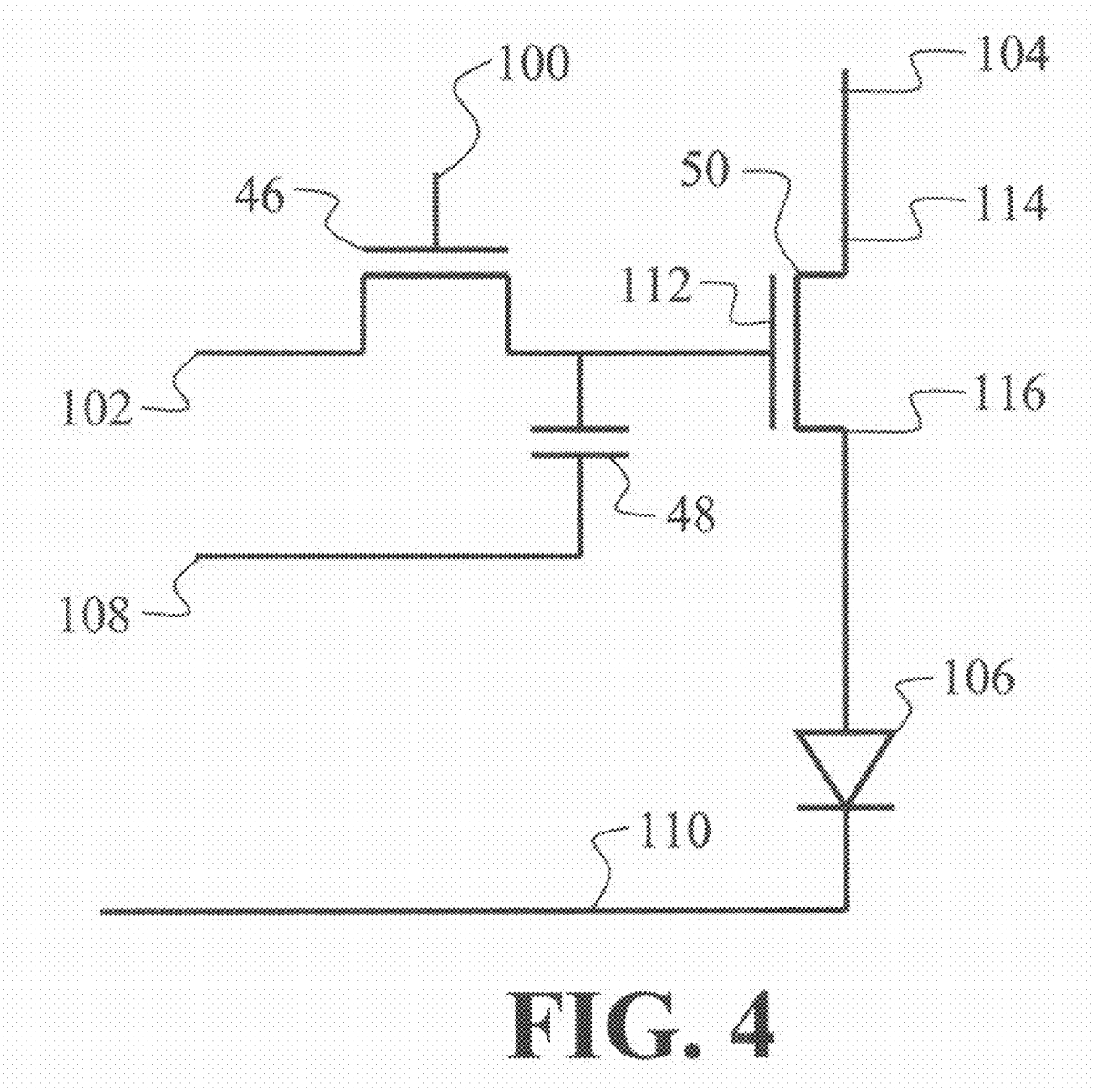
FIG. 4 is a circuit diagram for a pixel control circuit useful in controlling a non-inverted OLED in accordance with an embodiment of the invention.

The invention may be practiced in active matrix displays having any number of pixel driving circuits and EL light-emitting architectures for controlling the current provided to an EL light-emitting element, such as an OLED, as are known in the art. However, one pixel driving circuit useful for regulating the current for a non-inverted OLED light-emitting element within the display 10 in accordance with one embodiment of the current invention as depicted in FIG. 2 is shown in FIG. 4. As shown in this figure, this circuit is composed of a select line 100, a data line 102, a select TFT 46, a capacitor 48, a power TFT 50, a supply power line 104, OLED 106, a capacitor line 108 and a return power line 110. To drive the OLED to a desired luminance, a signal is provided on the select line 100, activating the select TFT 46. The voltage provided on the data line 102 is then used to charge the capacitor 48 to the desired voltage. When this voltage is available to the power TFT 50, the power TFT is activated and current is allowed to flow to the OLED 106. The circuit is completed through the return power line 110 to the power supply. In this embodiment the supply power line 104 and the return power line 110 form the pair of power lines.

Figure 5:
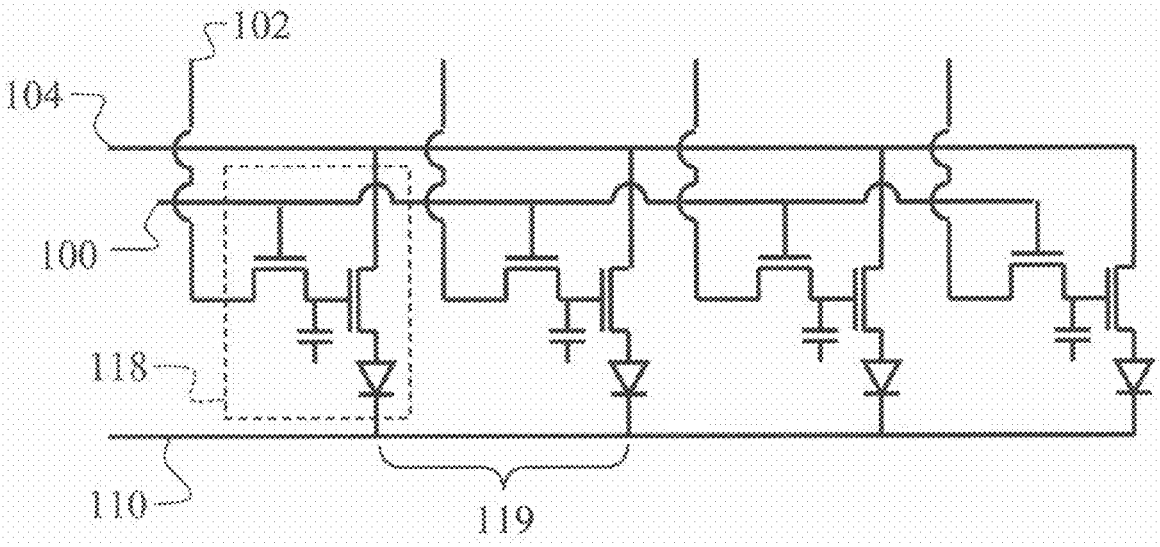
FIG. 5 is a circuit diagram depicting a region of a display in accordance with an embodiment of the invention.

This is further exemplified in FIG. 5, which shows four of the circuits 118 of FIG. 4, which are connected by a common supply power line 104 and a common return power line 110. In a display having supply 104 and return 110 power lines that have similar resistance, some amount of voltage drop will occur on each of these power lines between each of the circuit connections. Specifically, each segment 119 of each of the power lines 104, 110 between the location at which each circuit 118 is connected will have some resistance. This resistance is typically similar between each of the connection locations. Each segment 119 will typically be required to carry some current, with the segments of the power lines nearer the power source carrying the most current as these segments must provide current to the OLED in each circuit 118 while the ones near the end of the power lines must only provide current to the circuits 118 near the end of the power lines. The voltage drop across each segment 119 of each power line is then equal to the resistance of the power line segment multiplied by the current that must be provided across the same power line segment. Notice, therefore, that the IR drops that cause these voltage variations on the power lines are not constant but vary as a function of the current required to drive the OLEDs, which are provided power by any pair of power lines.

As discussed above, only one of these power lines is depicted in FIG. 2 as the OLED display may provide each of these power lines on the substrate shown in FIG. 2 or may provide one power line 24, 26 on the substrate and form a complimentary power line as a sheet of conductive material that is sputtered or evaporated over the entire OLED device. In such display configurations, the resistance of the sheet of conductive material may be much lower (e.g., an order of magnitude lower) than the resistance of the power lines 24, 26 which is formed on the substrate and can have a negligible IR drop, allowing the IR drop across this one power line to be ignored.

To understand the following discussion, it is further important to understand the portions of the power TFT 50 shown in FIG. 4; including the gate 112, drain 114, and source 116. Within this drive scheme, the current provided across the OLED 106 is ideally dependent upon only the characteristics of the power TFT 50 and the voltage provided by the data line 102. In fact, the current provided across the OLED 106 is dependent upon other factors, including the voltage between the gate 112 and source 116, which is dependent upon the voltage between the drain 114 and source 116. Therefore, voltage variation on the supply power line 104 and the return power line 110, due to IR drops along these lines, can alter the current provided across the OLED 106. In the case where the power TFT 50 is an n-type transistor, as is the case in an amorphous silicon (aSi) device, and the OLED is formed in a non-inverted structure, any variation in the voltage provided by the supply power line 104 results in variation of both the gate-to-source and drain-to-source voltages across the power TFT 50. Similarly, variations in the voltage provided by the return power line 110 results in variation of the drain-to-source voltage across the power TFT 50. In the case where the power TFT 50 is a p-type transistor, as is typically the case in low-temperature polysilicon (LTPS) devices, similar variation occurs when the OLED is formed in an inverted structure.

In a typical bottom-emitting active matrix OLED display, several light emitting elements share a common pair of power lines. Supply power lines often share a layer in the back plane of the display with other components. While typically laid out in a vertical direction and sharing a plane with data lines in the prior art in order to minimize their lengths, in a preferred embodiment of the invention, the supply power lines 104 may be laid out to run in the horizontal axis and share a plane with the select lines 100 in a display of the present invention so as to be perpendicular to the data lines. In either instance, these supply power lines often provide power to a narrow region of the display. The return power lines 110, on the other hand, are often constructed as a return power plane on top of the electroluminescent layers of the display. In some cases, the return power plane is connected to separate return power lines, similar to the supply power lines, on the backplane of the display. The need for these return power lines on the substrate is dependent upon the conductivity of the material used to create the return power plane. In other cases, each light-emitting element of the OLED display is separately connected to a return power line on the substrate. In this later case, the return power lines often return power from the same narrow region of the display defined by the supply power lines. When the return power line is constructed as a return power plane, it is possible that the return power line will have a significantly lower resistance than the supply power line. Under circumstances where one of the pair of power lines has a significantly lower resistance than the other, it may be adequate to estimate the current at, at least one point along the power line having the highest resistance.

Referring again to FIG. 2, the data lines 58, 60, 62, 64 typically provide only one control signal to one of the pixel driving circuits at any point in time, the display will typically further have an array of select lines 52, 54 and each of the data lines will substantially simultaneously provide a data signal to each of the pixel driving circuits that are further controlled by a select line which is oriented along the first dimension (i.e., horizontal as shown in FIG. 2). That is, when a voltage is provided on a select line 52, 54, each pixel driving circuit, which is connected to the select line 52, 54 will receive the data signal from the data line 58, 60, 62, 64 to which it is connected. When one region is provided power by a power line and all of the light-emitting elements within the region are connected to exactly one select line, all of the data will be clocked from the one or more display drivers into the pixel driving circuits for all of the light-emitting elements within the region.

While this embodiment refers to a specific configuration of active matrix drive circuitry and subpixel design, several variations of conventional circuits that are known in the art can also be applied to the present invention by those skilled in the art. For example, one variation in U.S. Pat. No. 5,550,066 connects the capacitors directly to the power line instead of a separate capacitor line. A variation in U.S. Pat. No. 6,476,419 uses two capacitors disposed directly over one and another, wherein the first capacitor is fabricated between the semiconductor layer and the gate conductor layer that forms gate conductor, and the second capacitor is fabricated between the gate conductor layer and the second conductor layer that forms power lines and data lines.

While the pixel drive circuit described herein requires a select transistor and a power transistor, several variations of these transistor designs are known in the art. For example, single- and multi-gate versions of transistors are known and have been applied to select transistors in prior art. A single-gate transistor includes a gate, a source and a drain. An example of the use of a single-gate type of transistor for the select transistor is shown in U.S. Pat. No. 6,429,599. A multi-gate transistor includes at least two gates electrically connected together and therefore a source, a drain, and at least one intermediate source-drain between the gates. An example of the use of a multi-gate type of transistor for the select transistor is shown in U.S. Pat. No. 6,476,419. This type of transistor can be represented in a circuit schematic by a single transistor or by two or more transistors in series in which the gates are connected and the source of one transistor is connected directly to the drain of the next transistor. While the performance of these designs can differ, both types of transistors serve the same function in the circuit and either type can be applied to the present invention by those skilled in the art. The example embodiment of the present invention, as shown in FIG. 2, has a multi-gate type select transistor 46.

Also known in the art is the use of multiple parallel transistors, which are typically applied to power transistor 50. Multiple parallel transistors are described in U.S. Pat. No. 6,501,448. Multiple parallel transistors consist of two or more transistors in which their sources connected together, their drains connected together, and their gates connected together. The multiple transistors are separated within the light emitting elements so as to provide multiple parallel paths for current flow. The use of multiple parallel transistors has the advantage of providing robustness against variability and defects in the semiconductor layer manufacturing process. While the power transistors described in the various embodiments of the present invention are shown as single transistors, multiple parallel transistors can be used by those skilled in the art and are understood to be within the spirit of the invention.

It is important to this invention that light emitting elements within at least two different regions 20, 22 of the display are provided power by different power supply or return lines 24, 26. In the embodiment depicted in FIG. 2, light emitting elements are provided power by separate power lines for each row of light emitting elements. For example, light emitting elements 30, 32, 34, 46 are provided power by supply power line 24 while light emitting elements 38, 40, 42, 44 are provided power by supply power line 26. It should also be noted that the supply power lines 24, 26 must share the area with other components on the backplane. For example, the supply power lines 24, 26, select lines 52, 54 and at least portions of the power TFT 50 will typically be formed in one layer of the substrate. Further, in bottom emitting OLED embodiments, these components are fabricated on a layer that is typically between the viewable side of the display and its light emitting layer. Since the supply power lines 24, 26, select lines 52, 54, and power TFT materials 50 are typically opaque, these components typically are designed so as not to overlap the emitting area. These constraints limit the width of the power lines 24, 26 within traditional backplane designs. It is further known that the performance of the power TFT is directly related to its thickness and therefore the thickness of the supply power line 24, 26 is often constrained to match the desired thickness of the power TFT, which is typically formed from the same metal layer. For these reasons, both the width and thickness of the power line is often constrained and the metals that are commonly used to form this layer (e.g., Aluminum) often have a significant, finite amount of resistance.

It is further understood that, due to the finite resistance of the supply power line, voltage losses may occur along the supply or return power lines when the power lines are subjected to high currents and that high currents will be required when the power lines must supply power to a large number of light emitting elements or the light emitting elements each require a high current to achieve a high luminance. In fact, the voltage loss will be proportional to the product of the resistance and current. Therefore, voltage will dissipate as a function of the distance along the power line. This dissipation will happen along the power and the return lines. In a circuit such as shown in FIG. 4, the voltage at the gate of the power TFT 50 directly affects the current that is provided across the OLED and since the light output of an OLED is directly proportional to the current that it is subjected to, a loss in voltage along one or both of the power lines 104, 110 will result in lower light output for light emitting elements connected to a common power line that are the furthest from the point where the power line is connected to an external power supply, where this loss of light output is proportional to the resistance of the power and return lines as well as the current that is required to display a desired input image signal.

Fortunately, the human visual system is relatively insensitive to low spatial frequency changes in luminance. Therefore, within a typical desktop or wall-mounted display, the luminance may vary by as much as 30 percent across the height or width of the display without being observable or at least objectionable to the human observer. Therefore, under many circumstances, the loss in voltage and the corresponding loss in display luminance with distance from the power supply may not result in substantial image quality artifacts. This is particularly true when displaying flat fields and many typical images. However, the inventors have determined that these unintended luminance variations resulting from IR drop along power lines can under certain circumstances be directly observed and objectionable to users of the display device. The inventors have also observed that while the artifacts may not be directly observable when viewing many typical images, these unintended luminance variations can degrade local contrast and therefore reduce the overall image quality.

Figure 6A:
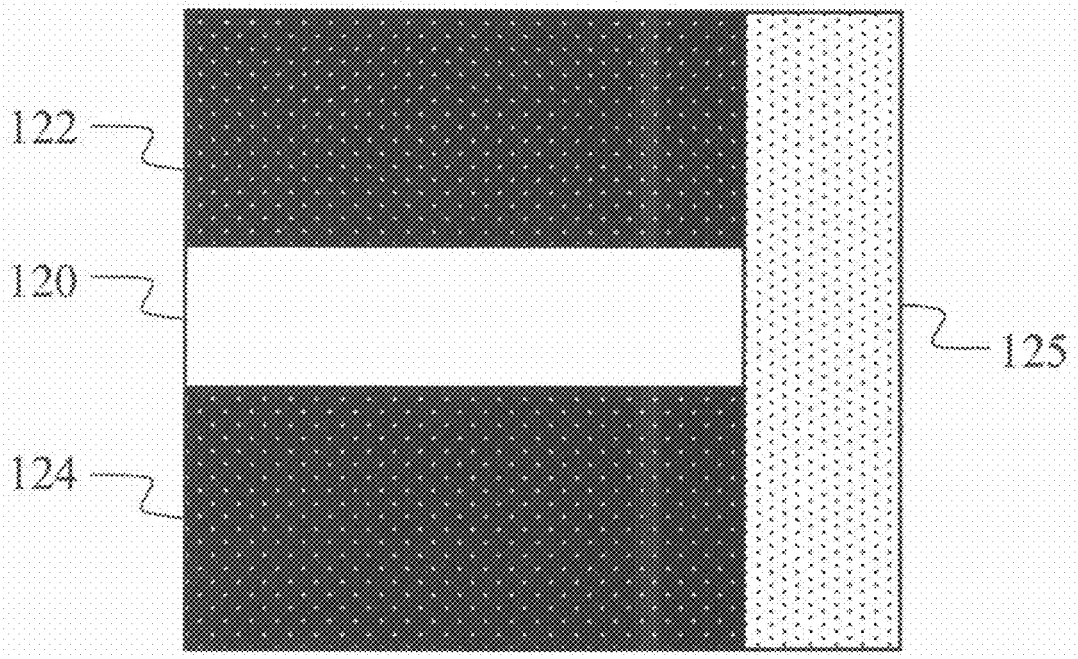
FIG. 6*a* is a depiction of a representative desired display image.
Figure 6B:
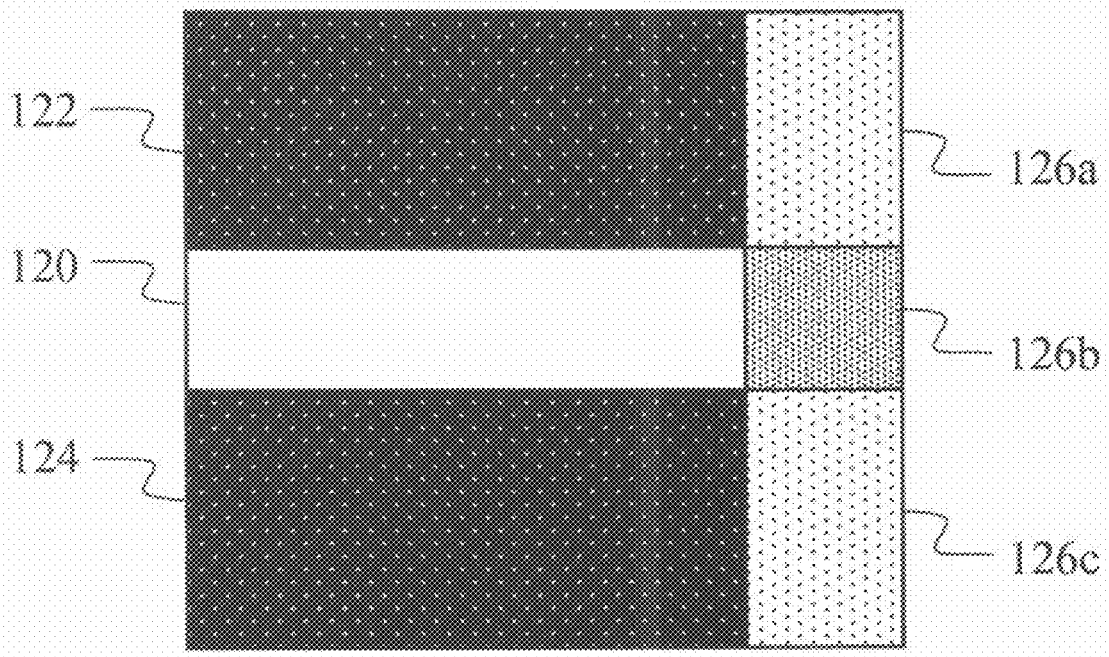
FIG. 6*b* is a depiction of an image artifact shown when displaying such desired image on a typical prior art display system.

FIG. 6*a* shows a depiction of a representative desired image which is likely to be degraded due to IR drop, and FIG. 6*b* provides a depiction of the image that will result due to IR drop. As shown in FIG. 6*a*, a white area 120 and two black areas 122, 124 are to be displayed at the left of the image. On the right of the image is to be displayed a gray bar 125 that is orthogonal to the first three bars and which has a uniform luminance. Although this image would be depicted as shown if presented on an EL display without IR drop, when IR drop is present on an EL display with the power connector at the left hand side of the display, the resulting image actually appears as shown in FIG. 6*b* when the white area 120 is driven such that it has a high current draw. While the white area 120 may be higher in luminance near the left of the display where the power lines enter the display than near the right of the display, because this luminance changes gradually, the human eye is typically incapable of detecting this gradual change. However, the appearance of the gray bar 125 in FIG. 6*a* is significantly affected by the IR drop and will appear to be formed of three bar segments 126*a*, 126*b*, and 126*c* in FIG. 6*b*, all of which have a different luminance even though the same input signal is used to drive the entire right edge of the display indicated by 125. While displayed using the same input voltage, gray bar (inclusive of 126*a*, 126*b*, 126*c*) is not uniform in luminance due to different IR drops along the different power lines driving the areas 126*a*, 126*b* and 126*c* as a result of the different currents drawn in area 120 relative to that in areas 122 and 124. In fact, the areas 126*a* and 126*c*, which are driven by the same power lines as the two black areas 122 and 124 will be significantly higher in luminance than the area 126*b*, which is driven by the same power lines as is the white area 120. Unlike the gradual change in luminance of the white bar from the left to the right of the display, the change in luminance across the gray bar (inclusive 126*a*, 126*b*, 126*c*), which is intended to be uniform, is sudden and visible. The luminance change occurs between neighboring OLEDs at the boundary between 126*a* and 126*b* and the boundary between 126*c* and 126*b*, due to the resulting difference in current between neighboring power lines. This sudden and unintended change in luminance is very detectable to the human eye and presents a very undesirable display artifact. It is the intent of embodiments within this disclosure to reduce the luminance variation that can occur between neighboring OLEDs that are driven by neighboring power lines when the peak luminance of the display is such that currents are high enough to create artifacts of this type.

It will be recognized that in each of the embodiments of the present invention, a display will be provided, a portion of such a display being depicted in FIG. 2, which is composed of an array of regions, wherein the current to each of the regions is provided by a pair power lines, at least one power line oriented along a first dimension of the display, each region including an array of light emitting elements for emitting light and wherein the current to each light emitting element is controlled by a pixel driving circuit. The display further comprising an array of select lines oriented along the first dimension of the display for sequentially providing a signal to the pixel driving circuits within each of the array of regions, allowing the pixel driving circuits within any one region to be selected to receive a data signal at any moment in time. The display further comprising an array of data lines oriented along a second dimension of the display that is perpendicular to the first dimension, wherein each data line provides a data signal to a pixel driving circuit within the selected region and wherein each pixel driving circuit independently controls the current to each of the light-emitting elements in response to the data signal that is provided by the data lines and wherein the intensity of the light output by each the light emitting element is dependent upon the current provided to each light emitting element.

Further, it will be recognized that embodiments of the present invention will employ one or more display drivers which receive an input image signal and generate a converted data signal to be provided to each of the pixel driving circuits by the data lines to drive the light emitting elements in the display, wherein the one or more display drivers receive the input image signal for driving the light emitting elements within a region, analyzes the input image signal to estimate the current that would result at, at least, one point along at least one of the power lines providing current to each of the regions if the pixel driving circuit was not influenced by voltage drops along the power line, and generates the converted image signal for driving the light emitting elements with the region as a function of the input image signal and the estimated currents, allowing the voltage drop to be computed across the region defined by the power line without delay. However, the details of the preferred embodiments may differ substantially based upon the exact structure of the EL unit. Herein, two separate processes will be used for two separate EL unit configurations. It should, however, be recognized that modifications to or combinations of these methods may be applied to achieve similar results.

Figure 7:
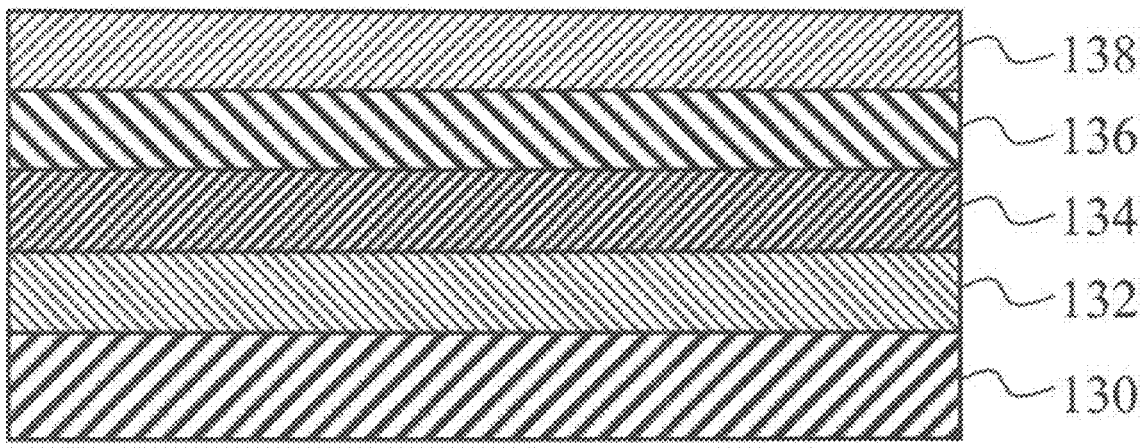
FIG. 7 is an illustration of the layers of a non-inverted OLED element useful in the present invention.

In a first embodiment, it will be assumed that a non-inverted OLED will be formed on an active matrix substrate employing an n-type semi-conducting material, such as amorphous silicon. By a non-inverted OLED, it is implied that the anode of the OLED is located near the substrate and the cathode of the OLED is formed opposite the OLED materials from the anode. The typical layer structure of such an embodiment is depicted in FIG. 7, which depicts a substrate 130 on which is coated the active matrix circuit elements of the display, which includes at least one semi-conducting layer 132. The anode, 134 is then formed in contact with the active matrix circuit and is used to inject holes into the EL layer 136. These holes will typically be injected into a hole injection or hole transporting sublayer within the EL layer through which they must pass to reach a light emitting sublayer. These holes will eventually combine with electrons in the light-emitting layers to form excitons, which may decay through florescence or phosphorescence to produce light emission. The cathode 138 will be formed on top of the EL layer and electrons will be injected into the EL layer which will combine with holes in the light-emitting layer to form excitons and light emission.

In such an embodiment, a circuit such as shown in FIG. 4 may be used to drive each light emitting element. In this configuration the current that flows from the source 116 to the gate 112 of the power transistor 50 is dependent on the voltage ($V_{gs}$) across the gate and source of this transistor. Further, Vgs is equal to the data voltage minus the voltage across the source and drain power lines, minus the voltage differential across the OLED. However, the voltage across the source and drain power lines is equal to the voltage across these lines as provided by the power supply minus the reduction in voltage that occurs as a function of the resistance of the power lines and the current that is required to drive other OLEDs along the power lines. Since current and voltage are generally nonlinearly related in these devices, the exact solution of this problem will generally require the solution of a family of nonlinear equations which can be relatively complex. In such a configuration, it can therefore be computationally less complex to simply limit the maximum current within one or more segments of the power line(s) such as to limit the IR drop to within an acceptable tolerance. The inventors have found that this may be accomplished by simply reducing the peak current of any given line to within some limit as long as luminance along any one region of the display is not substantially different from a neighboring region. Further, it is possible to take advantage of the correlation between frames within a video sequence to further occlude any luminance variation that occurs through the application of such a limiting process.

Figure 8:
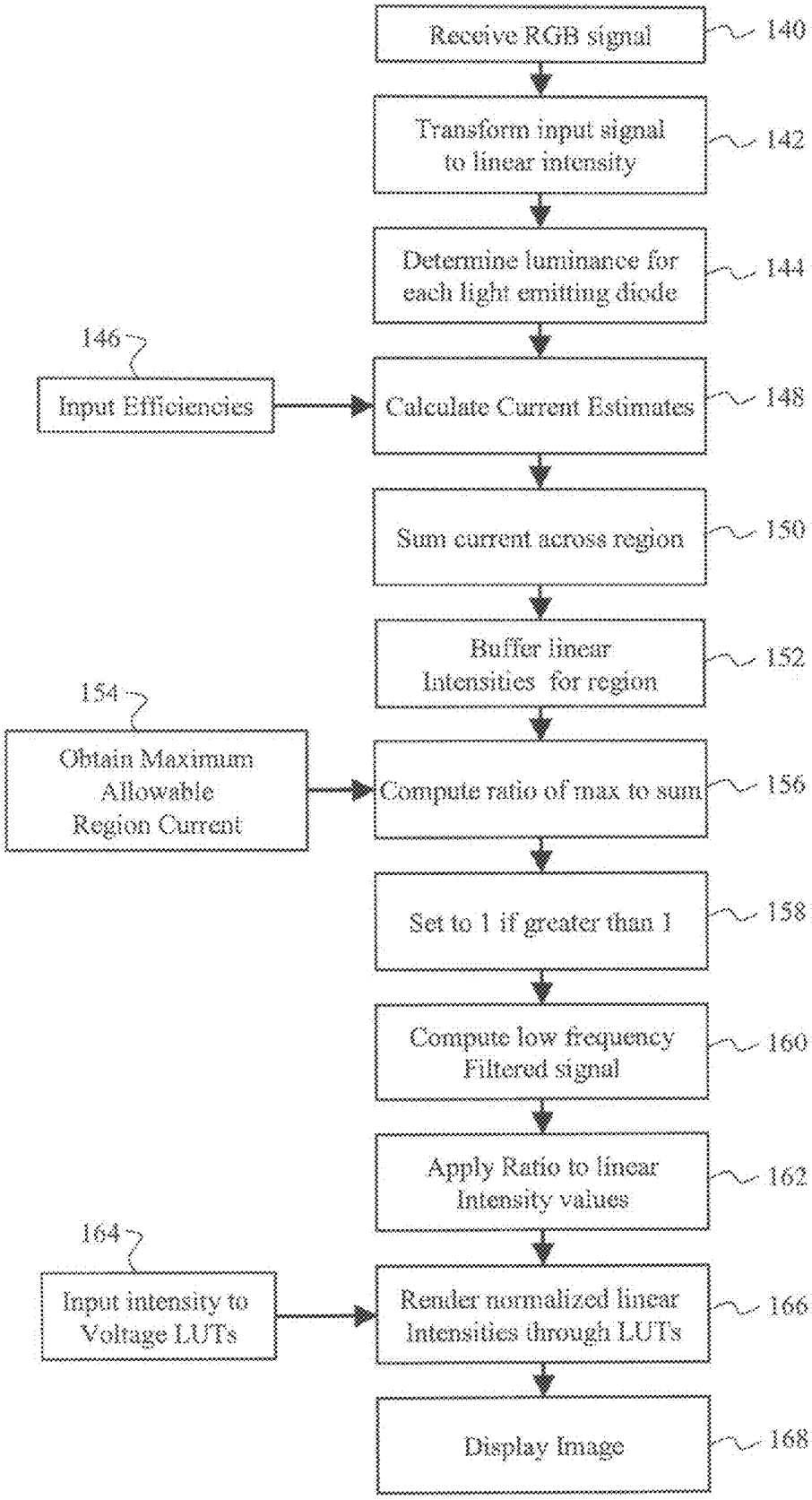
FIG. 8 is a flow diagram depicting a detailed set of steps for driving a display according to an embodiment of the present invention.

One such limiting process is depicted in FIG. 8. As shown in this figure, the one or more display drivers would receive 140 the input image signal, which would typically be comprised of input RGB code values. This input signal would then be transformed 142 to linear intensity values, typically by applying a nonlinear lookup table. The luminance of the light emitting elements corresponding to the pixel location of each RGB intensity value would then be determined 144 using methods that are well known in the art, such as applying a matrix multiplication. This step may rely on inputs from external sources such as a user luminance control, a user contrast control, an ambient illumination sensor and/or a temperature sensor. The luminance value may be adjusted based upon the inputs from these external sources to determine 144 the final luminance of the light emitting elements. The efficiencies of each light emitting element would then be input 146 and used to divide the required luminance to obtain the current that is required by each light-emitting element to calculate 148 an estimate of the current required by each light-emitting element. Notice that steps 142 through 148 provide an analysis of the input image signal to estimate the current that would result at, at least, one point along at least one of the power lines providing current to each of the regions if the pixel driving circuit was not influenced by voltage drops along the power line. The current required by each light-emitting element within a region of the display would then be summed 150 and the RGB intensity values would be buffered 152 for later computation. Once a total current was calculated for an entire region, a maximum allowable current for each region would be obtained 154 and a ratio of this maximum allowable to the sum of the current for the region is calculated 156. If this value is greater than 1, it is set 158 to a value of 1. A low pass filter is then applied 160 to the ratio computed in step 158. This step ensures the value for the current line does not change dramatically from the value for the previous line, therefore allowing only a low frequency shift in luminance to which the human visual system is not very sensitive. The resulting filtered ratio value is then applied 162 to the linear intensity values for each region to generate the converted image signal for driving the light emitting elements with the region as a function of the input image signal and the estimated currents. An input intensity to drive voltage look up table may then be input 164 and the converted image signal may be rendered 166 through these LUT to obtain display drive voltages, which are then produced on the appropriate data lines of the active matrix display to display 168 the image.

Notice that in this process, a buffer the size of each region (typically a line) is all that is necessary to generate the final adjusted image and that the delay in image presentation created through such a process is only the time required to clock a line of data into the line buffer. Although such a process can provide the necessary correction to the input image signal, many enhancements or modifications may be made to this process. In one such process, the ratio computed in step 158 may be stored for each region. The minimum of these values may then be recorded for each scene and established as a default ratio for the subsequent image. This default ratio may then be adjusted by calculating the ratio of the difference between the ratio computed for each region in the previous image and the ratio for each region of the current image and then adjusting this default ratio by some proportion of this difference. As such, the changes in this proportion as a function of location in the image may be minimized. Notice that such a process requires a small increase in the amount of necessary storage but image presentation is still only delayed by the time required to input the data for a single region of the image. Through such a process the inadvertent changes in row to row luminance due to IR drop may be significantly reduced. Further, this process may be combined with other methods known in the art for applying a limit to the maximum current draw for an image.

Figure 9:
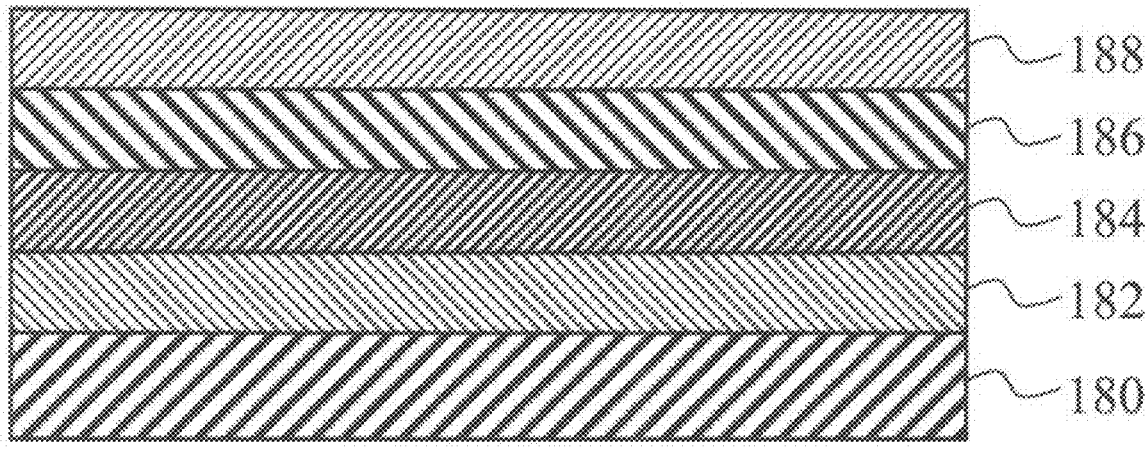
FIG. 9 is an illustration of the layers of an inverted OLED element useful in the present invention.
Figure 10:
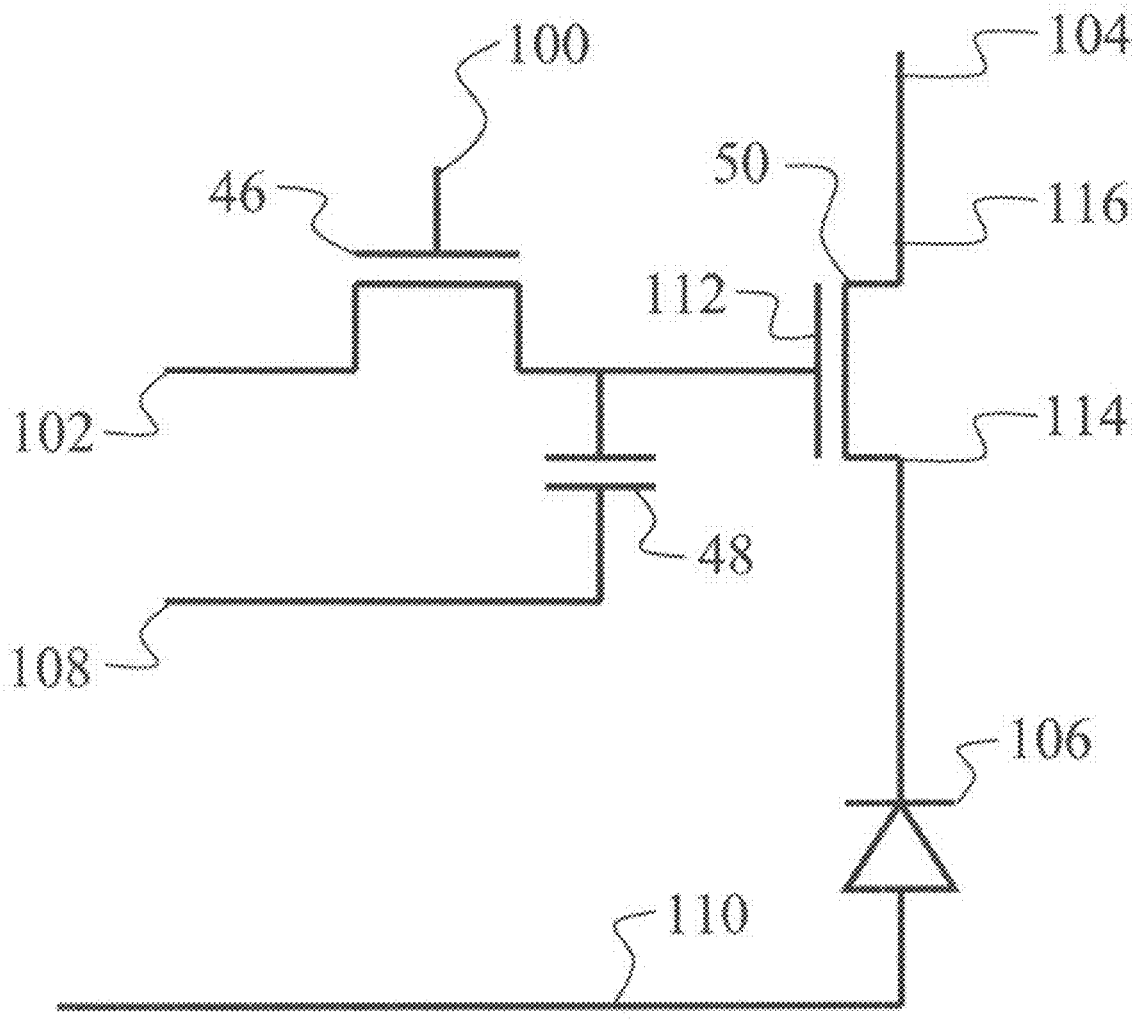
FIG. 10 is a circuit diagram for a pixel control circuit useful in controlling an inverted OLED in accordance with an embodiment of the invention.

In a second embodiment, it will be assumed that an inverted OLED will be formed near an active matrix substrate employing an n-type semi-conducting material. By an inverted OLED, it is implied that the cathode of the OLED is located on the semi-conducting substrate and the anode of the OLED is formed opposite the OLED materials from the cathode. The typical layer structure of such an embodiment is depicted in FIG. 9, which depicts a substrate 180 on which is coated the active matrix circuit elements of the display, which includes at least one semi-conducting layer 182. The cathode, 184 is then formed in contact with the active matrix circuit and is used to inject electrons into the electroluminescent layer 186. These electrons will typically be injected into an electron injection or electron-transporting layer and will eventually combine with holes in a light-emitting layer to produce light emission. The anode layer 188 will typically inject holes into a hole injection or hole-transporting layer through which they must pass to reach the light-emitting layer. A circuit to drive such a device is depicted in FIG. 10, and is nearly identical to the circuit shown in FIG. 4 with a few notable exceptions. Note that while in FIG. 4, the electrons flowed through the OLED 106 and then the power TFT 50, placing the source 116 of the power TFT near the bottom of the figure and the drain 114 of the TFT near the top of the figure, as shown in FIG. 9 for the inverted OLED, electrons flow through the power TFT and then the OLED 106, placing the source of the power TFT 50 and the supply power line 104 near the top of the figure. Further, the drain 114 of the power TFT 50 and the return power line 110 is placed near the bottom of the figure. One of the more significant effects of this change is that it simplifies the calculation of the gate 112 to source 116 voltage, which is now simply the difference between the data signal voltage and the voltage between the source and drain power lines, theoretically making it much easier to effect exact control upon the current to the OLED 106 and therefore the luminance produced by the light emitting element. Unfortunately, this same change results in greater sensitivity of such a display to variation in IR drop as the gate 112 to source 116 voltage is very sensitive to changes in the voltage between the supply 104 and return 110 power lines due to the fact that the data signal voltage is often much smaller than the gate to source voltage. Because of its extreme sensitivity to IR drop, manufacturing of such a device is typically avoided. Accordingly, systems employing voltage drop compensation in accordance with the invention may be particularly desirable for use with inverted OLED elements.

The inventors have further noted that the effect of IR drop in such an inverted OLED display configuration may advantageously be modeled by simply solving a set of linear equations. While it is possible to form a converted image signal that compensates for IR drop in other OLED configurations, the fact that the gate to source voltage in an inverted configuration is only affected by the data signal voltage and the voltage across the power lines, makes it particularly advantageous to form a converted image signal that compensates for the effect of IR drop, rather than attempting to simply ameliorate its effects by avoiding high current values as discussed in the first embodiment. Further, these calculations may be simplified such that the steps of analyzing the input image signal 82 and generating a converted image signal 84 may be performed within the column drivers of most typical displays while adding only a few processing steps. Such a method will therefore be provided in detail.

To discuss this method, it is first important to define the actual voltage between the supply and return power lines in terms of linear equations. As such, we will define the following vectors:

$$\tilde{v} = \begin{bmatrix} v_1 \\ v_2 \\ . \\ . \\ v_n \end{bmatrix},$$

$$\tilde{i} = \begin{bmatrix} i_1 \\ i_2 \\ . \\ . \\ i_n \end{bmatrix},$$

$$\tilde{v}_0 = \begin{bmatrix} v_0 \\ v_0 \\ . \\ . \\ v_0 \end{bmatrix};$$

where $\tilde{v}$ is a column vector representing the actual voltage of the power line at each circuit connection, $\tilde{i}$ is a column vector representing the current for each segment 119 of at least one of the power lines (note the current for a given segment of one power line is typically equal to the current for a corresponding segment of the other power line in the pair of power lines), and $\tilde{v}_0$ is a vector of the initial voltage values at the origins of the power lines as provided by the power supply. Further, we will define a symmetric matrix, A. This matrix is defined by assigning the number of circuits 118 along a power line to a row and a column vector, treating these arrays as indices to a matrix and then computing each value in the matrix as the minimum of the row and column index value at each point in the matrix. For example, a display having eight circuits attached to a pair of power lines would have a matrix A as:

$$A = \begin{bmatrix} 1 & 1 & 1 & 1 & 1 & 1 & 1 & 1 \\ 1 & 2 & 2 & 2 & 2 & 2 & 2 & 2 \\ 1 & 2 & 3 & 3 & 3 & 3 & 3 & 3 \\ 1 & 2 & 3 & 4 & 4 & 4 & 4 & 4 \\ 1 & 2 & 3 & 4 & 5 & 5 & 5 & 5 \\ 1 & 2 & 3 & 4 & 5 & 6 & 6 & 6 \\ 1 & 2 & 3 & 4 & 5 & 6 & 7 & 7 \\ 1 & 2 & 3 & 4 & 5 & 6 & 7 & 8 \end{bmatrix}.$$

This matrix would then be expanded to provide a number of rows and columns equal to the number of circuits 118 attached to a pair of supply 104 and return 110 power lines.

Given this set of matrices and assuming the resistance of each segment in each power line is constant; the array of voltage values $\tilde{v}$, representing the voltage at each circuit connection can then be computed from the equation:

$$\tilde{v}=\tilde{v}_0-r*A\tilde{i}$$

where r represents the resistance of each segment in one of the power lines or, if the resistance of each segment of each of the power lines in the pair are comparable, the sum of the resistance values for the two power lines.

Having calculated the actual voltage at the connection for each circuit, one can correct for IR drop by adding the quantities calculated from:

$$\tilde{v}_c=\tilde{v}_0-\tilde{v}$$

to the drive voltage value for each light emitting element when the display utilizes an inverted OLED with an n-type semiconductor backplane. This same correction can be applied to an OLED utilizing a non-inverted OLED with a p-type semiconductor backplane.

This method needs to be slightly adapted if the OLED is formed as a non-inverted OLED on an n-type semiconductor backplane or an inverted OLED on a p-type semiconductor backplane. For this later case, the IR drop can be corrected for by a slightly different corrected voltage to the drive voltage for each light emitting element. This value is calculated from:

$$\tilde{v}_c=b(\tilde{v}_0-\tilde{v})/a$$

where b is the slope of the power transistor curve which relates source to drain current to source to drain voltage and a is the slope of the transistor curve relating the source to drain current to the gate to source voltage at the operating point. Note however, that as pointed out before, the operating point is the value that is being calculated. However, this operating point may be approximated in any number of ways, including calculating an initial value of $\tilde{v}_c$ assuming that a and b are 1 or have an average value for the slope of the curve.

While the matrix equations that have been discussed will allow the correction to be applied, it is important to note that the matrix A is actually very large for most commercialized displays. For instance televisions supporting HDTV resolutions may have as many as 5760 (1920 pixels by three colors of light emitting elements per pixel) light emitting elements in a single row and that all of these light-emitting elements will ideally be provided power by a single pair of power lines. To provide this computation for such a display, an A matrix with over 3.3 million entries would be required. This matrix would require an unmanageable amount of data storage and the solution would require an unacceptable number of computations. Fortunately, this matrix computation may be simplified by decomposing the n by n A matrix into p by p equally sized submatrix blocks (each with q=n/p rows and columns). To explain this simplification, the A matrix shown earlier will be decomposed into two diagonal matrices, a super diagonal matrix (i.e, above the diagonal) and a subdiagonal matrix as shown for the case of n=8, p=2, q=4.

$$A = \begin{bmatrix} \begin{bmatrix} 1 & 1 & 1 & 1 \\ 1 & 2 & 2 & 2 \\ 1 & 2 & 3 & 3 \\ 1 & 2 & 3 & 4 \end{bmatrix} & \begin{bmatrix} 1 & 1 & 1 & 1 \\ 2 & 2 & 2 & 2 \\ 3 & 3 & 3 & 3 \\ 4 & 4 & 4 & 4 \end{bmatrix} \\ \begin{bmatrix} 1 & 2 & 3 & 4 \\ 1 & 2 & 3 & 4 \\ 1 & 2 & 3 & 4 \\ 1 & 2 & 3 & 4 \end{bmatrix} & \begin{bmatrix} 5 & 5 & 5 & 5 \\ 5 & 6 & 6 & 6 \\ 5 & 6 & 7 & 7 \\ 5 & 6 & 7 & 8 \end{bmatrix} \end{bmatrix}$$

Notice that the columns of the super diagonal submatrix is composed of four rows of numbers, each column of each row containing the same number. Therefore, computation of the quantity obtained by multiplying the appropriate current values by this super diagonal submatrix of A can be computed from:

$$A_{Super}\tilde{i} = s\sum_{k=k_0}^{k_0+q-1} i_k, \quad \text{(Eq 1)}$$

where s is the row number in the original matrix and k is an index that is incremented over all columns of the superdiagonal submatrix.

Additionally, each of the columns of the subdiagonal submatrix also contain the same number and therefore computation of these elements can also be simplified to:

$$A_{Sub}\tilde{i} = \sum_{k=k_0}^{k_0+q-1} i_k k = \sum_{k=k_0}^{k_0+q-1} i_k(k-k_0+1) + (k_0-1)\sum_{k=k_0}^{k_0+q-1} i_k, \quad \text{(Eq 2)}$$

where k is the column number in the original matrix and is incremented over all columns in the subdiagonal submatrix. Note that the matrix multiplication of the currents and the A matrix in the sub-diagonal and super-diagonal submatrices only involves sums of the form:

$$S_0 = \sum_{k=k_0} i_k$$

and $$S_1 = \sum_{k=k_0} i_k(k-k_0+1)$$

which are constant for all corrections $\tilde{v}_c = \tilde{v}_0 - \tilde{v}$ within a submatrix, except for an integer multiplier which varies with row number.

To compute the full matrix, it is then only necessary to perform the additional matrix multiplications for the submatrices on the diagonal of the original matrix. Further, this operation may be performed at any scale. For example, a display with 3 million horizontal light emitting elements, the A matrix may be decomposed into a very large number (p) of submatrices and the off diagonal matrices may each be calculated using these relatively simple equations and then summed together.

Note that the exact correction for voltage artifacts is given using these same simple sums ($S_0$ and $S_1$) for first and last rows of the diagonal submatrix blocks. It is only the interior rows of the diagonal submatricies that require unique summations for each row.

If small errors in the correction can be tolerated, it is possible to determine the correction for the interior rows of each sub-matrix block by interpolation from the first and last row (since these corrections are calculated exactly from the sub-matrix and supermatrix sums). If the accuracy of the correction is to be improved, the diagonal matrix itself can be subdivided into smaller submatrices (super diagonal, sub diagonal, and diagonal) and the same process repeated until the desired accuracy is achieved for the rows inside the smallest submatrices.

Figure 11:
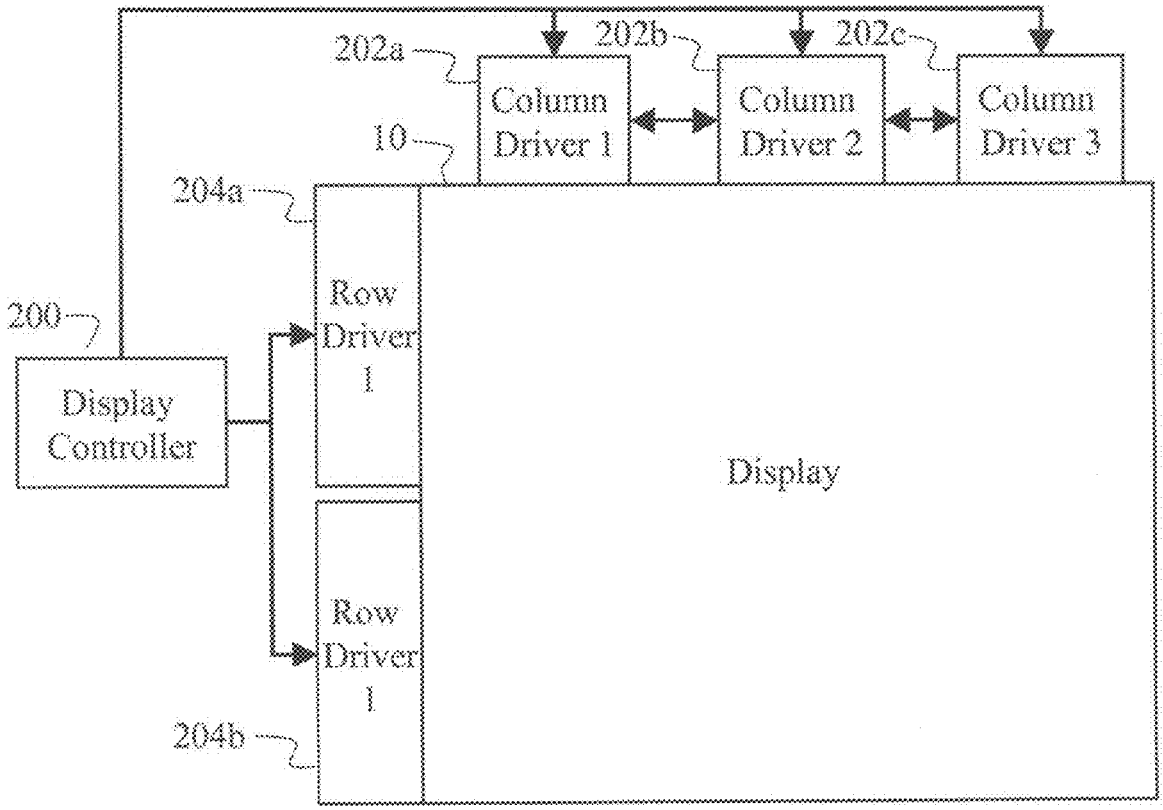
FIG. 11 is a top view of a display useful for practicing an embodiment of the present invention employing multiple row and column drivers.

Note that these computations may be computed within a single processor but because $S_0$ and $S_1$ can be computed within any submatrix without knowledge of the values in other submatrices, many of the computations may be performed in parallel by multiple processors. In most active matrix displays numerous row drivers 204*a*, 204*b* and column drivers 202*a*, 202*b*, 202*c* are either formed on or bonded to the edges of the display 10 as shown in FIG. 11. Data is then delivered to the row drivers 204*a*, 204*b* and column drivers 202*a*, 202*b*, 202*c* by a display controller 200. The column drivers 202*a*, 202*b*, 202*c* deliver the drive voltage to the data lines 58, 60, 62, 64 of the display 10 while the row drivers 204*a*, 204*b* deliver select signals to the select lines 52, 54.

Figure 12:
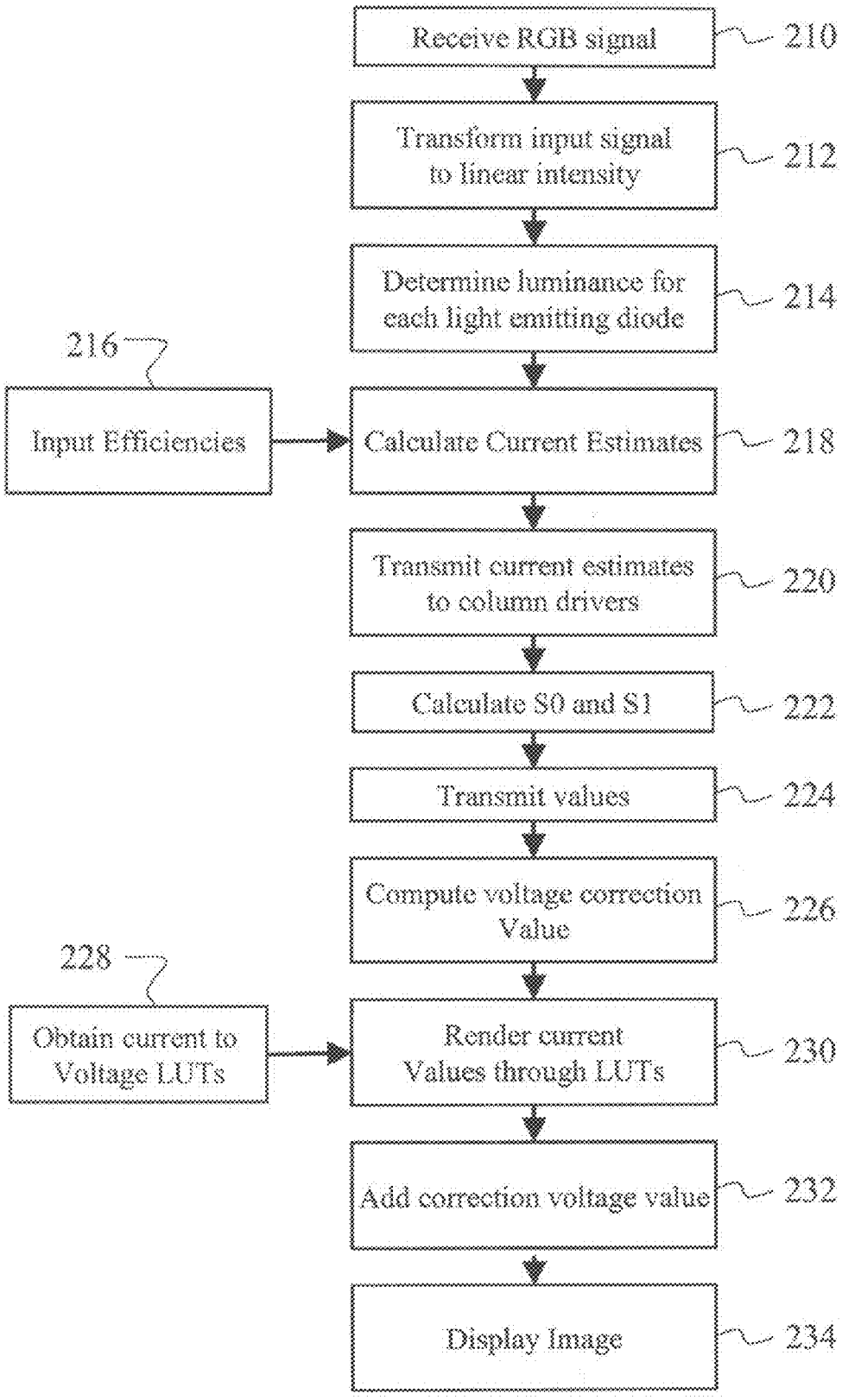
FIG. 12 is a flow diagram depicting a detailed set of steps for driving a display according to another embodiment of the present invention.

Therefore, in a preferred embodiment, employing the method that has just been described and the display system depicted in FIG. 11, the one or more display drivers for receiving an input image signal for data to drive the pixel driving circuits and generating a converted image signal 16 for driving the light emitting elements in the display 10 may include at least one display controller 200 and one or more column drivers 202*a*, 202*b*, 202*c*, which employ the process shown in FIG. 12. As shown in FIG. 12, the display controller 200 would receive 210 the input image signal, which would typically be comprised of input RGB code values. This input signal would then be transformed 212 to linear intensity values, typically by applying a nonlinear lookup table and matrix multiplication. The luminance of the light emitting elements corresponding to the pixel location of each RGB intensity value would then be determined 214 using methods that are well known in the art. This step may rely on inputs from external sources such as a user luminance control, a user contrast control, an ambient illumination sensor and/or a temperature sensor. The luminance value may be adjusted based upon the inputs from these external sources to determine 214 the final luminance of the light emitting elements. The efficiencies of each light emitting element would then be input 216 and used to divide the required luminance to obtain the current that is required by each light-emitting element to calculate 218 an estimate of the current required by each light-emitting element. Notice that steps 212 through 218 provide an analysis of the input image signal to estimate the current that would result at, at least, one point along at least one of the power lines providing current to each of the regions if the pixel driving circuit was not influenced by voltage drops along the power line. These current values would then be transmitted 220 to the column drivers 202*a*, 202*b*, 202*c* with each column driver receiving current values for the light emitting elements to which it must provide a signal for driving. The column drivers may then calculate 222 $S_1$ and $S_0$ for the submatrix corresponding to light emitting elements to which they must provide a data signal through the drive lines 58, 60, 62, 64. Each of the column drivers 202*a*, 202*b*, 202*c* may then transmit 224 the computed values of $S_1$ and $S_0$ to the other column drivers. The voltage correction value $V_c$ is then computed 226 for each light emitting element. The column drivers then obtain 228 look up tables to convert from current to voltage and render 230 the current values through the LUTs to obtain drive voltage values. A converted image signal is then formed by adding 232 the voltage correction value Vc to the drive voltage values to form the converted image signal for driving the light emitting elements in the display. The resulting voltage values are then converted to an analog signal and provided on the data lines to drive the light emitting elements of the display and to therefore display 234 the corrected image.

It should also be noted that the display controller 200 must also provide a synchronization signal to the row drivers and some delay may be introduced by either the display controller or the row drivers, which will allow the column drivers to perform the necessary calculations before providing the corrected voltage values to the data lines. It should also be noted that it is possible that some of the corrected voltage values may potentially be out of range of the voltage values that may be provided by the column drivers. In this instance, one may take any number of measures, including clipping the values to the highest available values, scaling each of the correction values for the line or some combination of these mechanisms.

The invention has been described in detail with particular reference to certain preferred embodiments thereof, but it will be understood that variations and modifications can be effected within the spirit and scope of the invention.

PARTS LIST

10 display
12 display driver
14 power supply
16 input image signal
18 converted data signal
20 first region
22 second region
24 first power line
26 second power line
30 light emitting element
32 light emitting element
34 light emitting element
36 light emitting element
38 light emitting element
40 light emitting element
42 light emitting element
44 light emitting element
46 select TFT
48 capacitor
50 power TFT
52 select line
54 select line
58 data line
60 data line
62 data line
64 data line
80 receive input image signal step
82 analyzes the input image signal step
84 generating the converted image signal step
100 select line
102 data line
104 supply power line
106 OLED
108 capacitor line
110 return power line
112 gate
114 drain
116 source
118 pixel driving circuit
119 power line segment
120 white area
122 black area
124 black area
125 uniform luminance gray bar
126*a* high luminance portion of gray bar
126*b* low luminance portion of gray bar
126*c* high luminance portion of gray bar
130 substrate
132 semi-conducting layer
134 anode
136 EL layer
138 cathode
140 receive input image signal step
142 transform to linear intensity step
144 determine luminance step
146 input efficiencies step
148 calculate current estimate step
150 sum current step
152 buffer intensity values step
154 obtain maximum allowable current step
156 calculate ratio step
158 set ratio
160 apply low pass filter step
162 apply filtered ratio value step
164 input look up table step
166 render step
168 display step
180 substrate
182 semi-conducting layer
184 cathode
186 electroluminescent layer
188 anode layer
200 display controller
202*a* column driver
202*b* column driver
202*c* column driver
204*a* row driver
204*b* row driver
210 receive input image signal step
212 transform to linear intensity step
214 determine luminance step
216 input efficiencies step
218 calculate current estimate step
220 transmit current value step
222 calculate $S_1$, $S_0$ step
224 transmit step
226 compute voltage correction step
228 obtain look up table step
230 render step
232 add voltage correction step
234 display step

The invention claimed is:

1. An active matrix electro-luminescent display system, comprising:

a) a display composed of an array of a plurality of regions, wherein the current to each of the regions is provided by a pair power lines, at least one power line oriented along a first dimension of the display, each region including an array of light emitting elements for emitting light and each power line having a resistance;

b) pixel driving circuits for independently controlling the current to each light-emitting element in response to an image signal, wherein the intensity of the light output by the light emitting elements is dependent upon the current provided to each light emitting element;

c) an array of select lines oriented along the first dimension for sequentially providing a signal to the pixel driving circuits within each region of the array of regions, allowing the pixel driving circuits within any one region to be selected to receive a data signal at any moment in time;

d) an array of data lines oriented along a second dimension of the display that is perpendicular to the first dimension, wherein the data lines provide the image signal to the pixel driving circuit for each light-emitting element;

e) one or more display drivers for receiving an input image signal for data to drive the pixel driving circuits and generating a converted image signal for driving the light emitting elements in each region of the display through signals provided through the data lines and select lines, wherein the one or more display drivers sequentially receives the input image signal for driving the light emitting elements within each region of the array of regions, analyzes the input image signal received for each region to estimate the current that would result at, at least, one point along at least one of the power lines providing current to each region, if employed without further modification, based upon device architecture, the resistance of a power line and material and performance characteristics of device components, and sequentially generates a converted image signal for driving the light emitting elements in each region as a function of the input image signal and the estimated currents wherein the one or more display drivers generate the converted image signal as a function of one or more normalization constants based on the relative values of the estimated currents and a reference value.

2. The display system according to claim 1, wherein the light-emitting elements comprise OLEDs.

3. The display system according to claim 2, wherein the pixel driving circuits control the voltage that is provided to the light-emitting elements, indirectly controlling the current supplied to each light-emitting element within each region.

4. The display system according to claim 3, wherein the one or more display drivers estimate the voltage drop across at least one portion of at least one of the pair of power lines based on the estimated current at, at least, one point along the power line and the resistance of the power line and generates the converted image signal based on the estimated voltage drop.

5. The display system according to claim 4, wherein the light-emitting elements are comprised of an inverted light-emitting structure and wherein the voltage provided to the light-emitting elements is corrected by adding the estimated voltage drop to an original voltage for driving the circuit.

6. The display system according to claim 5, wherein the one or more display drivers sequentially generate a converted image signal for driving the light emitting elements in each region by computing a sum of estimated current values along at least one of the power lines at multiple points corresponding to pixel driving circuit connections and a sum of the estimated current values at the multiple points multiplied by index values;

estimating voltage drops at each of the multiple points along the power lines based upon the sum of the estimated current values multiplied by a resistance value, and the sum of the estimated current values multiplied by index values multiplied by a resistance value;

computing initial drive voltages for each of the pixel driving circuits in each region from the input image signal; and calculating corrected drive voltages for each of the pixel driving circuits based upon the sum of the estimated voltage drop at the pixel driving circuit connection and the computed initial drive voltage.

7. The display system according to claim 4, wherein the light-emitting elements are comprised of a non-inverted light-emitting structure and wherein the voltage provided to the light-emitting elements is corrected by determining the current drop that would occur as a result of the voltage drop and wherein a relative current value is corrected by adding the current drop to an original current estimate and a corrected voltage is computed by converting the current value to a drive voltage signal for providing a voltage for driving the pixel driving circuit.

8. The display system according to claim 1, wherein the one or more display drivers modify the input image signal such that when i) the input image signal includes a target area of desired uniform luminance that spans two or more regions and ii) the average input image signal used to drive the light emitting elements outside the target within one of the two or more regions is significantly higher than the average input image signal used to drive the light emitting elements outside the target within an other of the two or more regions, the luminance pattern that results from displaying the image is more uniform in the target area when the converted image signal is used for driving the light emitting elements of the display than if the input image signal were to be used for driving the light emitting elements.

9. The display system according to claim 1, wherein the one or more display drivers estimate peak currents for each power line and compute a normalization constant based on the ratio of the maximum estimated peak current to the reference value, and applies the normalization constant to the input image signal to generate the converted image signal.

10. The display according to claim 1, wherein the one or more display drivers store a value for each of the array of regions and computes one or more normalization constants for a region as a function of the difference between the estimated currents and the stored value for the region to generate the converted image signal.

11. The display system according to claim 1, wherein the one or more display drivers generate the converted image signal by computing modified normalization constants for each region as a filtered version of an initial set of normalization constants previously computed for neighboring regions.

12. The display system according to claim 1, wherein the one or more display drivers generate converted image signals for individual input image signals in a temporal image sequence by computing modified normalization constants for the multiple input image signals as a filtered version of an initial set of normalization constants computed for previous images in the sequence.

13. The display system according to claim 1, wherein at least one of the regions contains differently colored light emitting elements than at least a second of the regions.

14. The display system according to claim 1, wherein at least one of the regions contains more than one color of light emitting element.

15. The display system according to claim 1, wherein the display contains more than three different colors of light emitting elements, and the display driver transforms a three-color input image signal to a four or more color image input signal, and generates the converted image signal for driving the light emitting elements in the display as a function of the four or more color input image signal and estimated currents that would result at, at least, one point along each power line if employed without further modification of the four or more color input image signal.

16. The display system according to claim 1, wherein the display driver additionally modifies the input image signal as a function of one or more of the set including, a user luminance control, a user contrast control, an ambient illumination sensor and/or a temperature sensor.

17. The display system according to claim 1, wherein the display contains at least four differently-colored light-emitting elements and wherein each region contains all colors of light-emitting elements.

18. The display system according to claim 1, wherein the pixel driving circuits are comprised of amorphous silicon thin film transistors.

19. The display system according to claim 1, wherein the one or more display drivers include one or more display column drivers.

20. An active matrix electro-luminescent display system, comprising:

a) a display composed of an array of a plurality of regions, wherein the current to each of the regions is provided by a pair power lines, at least one power line oriented along a first dimension of the display, each region including an array of light emitting elements for emitting light and each power line having a resistance;

b) pixel driving circuits for independently controlling the current to each light-emitting element in response to an image signal, wherein the intensity of the light output by the light emitting elements is dependent upon the current provided to each light emitting element;

c) an array of select lines oriented along the first dimension for sequentially providing a signal to the pixel driving circuits within each region of the array of regions, allowing the pixel driving circuits within any one region to be selected to receive a data signal at any moment in time;

d) an array of data lines oriented along a second dimension of the display that is perpendicular to the first dimension, wherein the data lines provide the image signal to the pixel driving circuit for each light-emitting element;

e) one or more display drivers for receiving an input image signal for data to drive the pixel driving circuits and generating a converted image signal for driving the light emitting elements in each region of the display through signals provided through the data lines and select lines, wherein the one or more display drivers sequentially receives the input image signal for driving the light emitting elements within each region of the array of regions, analyzes the input image signal received for each region to estimate the current that would result at, at least, one point along at least one of the power lines providing current to each region, if employed without further modification, based upon device architecture, the resistance of a power line and material and performance characteristics of device components, and sequentially generates a converted image signal for driving the light emitting elements in each region as a function of the input image signal and the estimated currents wherein the one or more display drivers sequentially generate a converted image signal for driving the light emitting elements in each region by:

computing a sum of estimated current values along at least one of the power lines at multiple points corresponding to pixel driving circuit connections and a sum of the estimated current values at the multiple points multiplied by index values;

estimating voltage drops at each of the multiple points along the power lines based upon the sum of the estimated current values multiplied by a resistance value, and the sum of the estimated current values multiplied by index values multiplied by a resistance value;

computing initial drive voltages for each of the pixel driving circuits in each region from the input image signal; and calculating corrected drive voltages for each of the pixel driving circuits based upon the sum of the estimated voltage drop at the pixel driving circuit connection and the computed initial drive voltage.

* * * * *